US005845454A

United States Patent [19]

Malizia

[11] Patent Number: 5,845,454

[45] Date of Patent: Dec. 8, 1998

[54] DROP CEILING HANGING SYSTEM

[76] Inventor: John T. Malizia, 2914 N. Mercer St., New Castle, Pa. 16105

[21] Appl. No.: 636,232

[22] Filed: Apr. 23, 1996

[51] Int. Cl.[6] ..... E04B 9/20; E04B 1/38

[52] U.S. Cl. ..... 52/713; 52/506.07; 248/327; 403/105

[58] Field of Search ..... 52/506.06, 506.07, 52/506.08, 512, 712, 713; 248/327, 333, 336, 317; 403/298, 105; 24/585, 584

[56] References Cited

U.S. PATENT DOCUMENTS

| | | | |
|---|---|---|---|
| 766,890 | 8/1904 | Newberg | 403/105 X |
| 1,092,815 | 4/1914 | Roeder | 248/327 |
| 1,327,611 | 1/1920 | Burns et al. | 403/105 |
| 1,470,728 | 10/1923 | Hall | 52/712 X |
| 1,606,289 | 11/1926 | Bowers | 52/713 X |
| 2,060,046 | 11/1936 | Di Giacomo | 248/327 X |
| 3,387,809 | 6/1968 | Zwerling | 248/317 X |
| 3,471,185 | 10/1969 | Parr | 24/585 X |
| 3,662,617 | 5/1972 | Bennett et al. | 403/105 X |
| 4,084,364 | 4/1978 | Jones | 52/506.07 |
| 4,947,607 | 8/1990 | Stein | 52/506.06 |
| 5,357,722 | 10/1994 | Kessler | 52/506.06 X |
| 5,397,090 | 3/1995 | Carson et al. | 248/327 |

FOREIGN PATENT DOCUMENTS

| | | | |
|---|---|---|---|
| 251787 | 5/1963 | Australia | 52/506.07 |
| 856600 | 12/1960 | United Kingdom | 52/506.06 |

*Primary Examiner*—Michael Safavi

[57] ABSTRACT

A system whereby a user can adjustably interconnect a drop ceiling frame to an existing ceiling joist. In its broadest context, the system includes a ceiling joist screw which is adapted to be positioned within a ceiling joist; a linkage which is adapted to be connected to the joist screw; an adjustment cylinder which is secured to the lower end of the linkage; and a threaded J-hook which is adapted the adjustably positioned within the adjustment cylinder. With this system, a user can easily install a drop ceiling frame to the desired height.

1 Claim, 3 Drawing Sheets

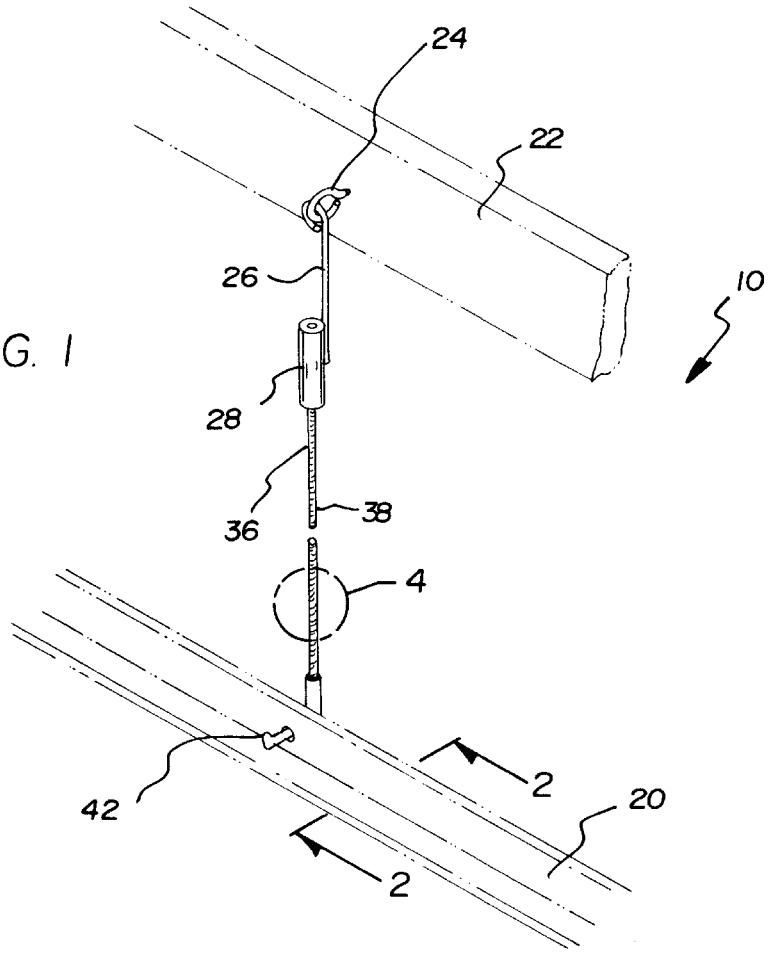
FIG. 1
FIG. 2
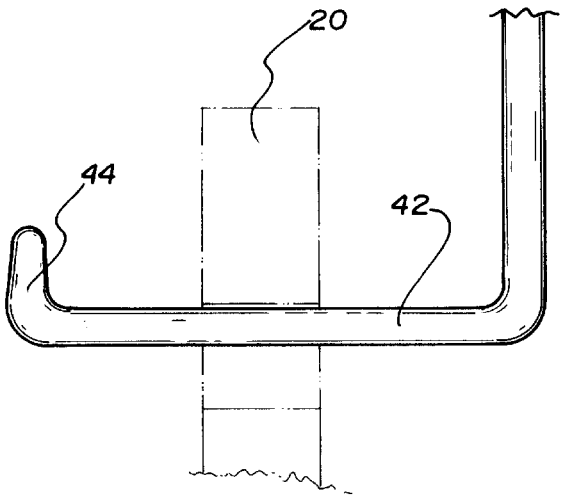

FIG. 5
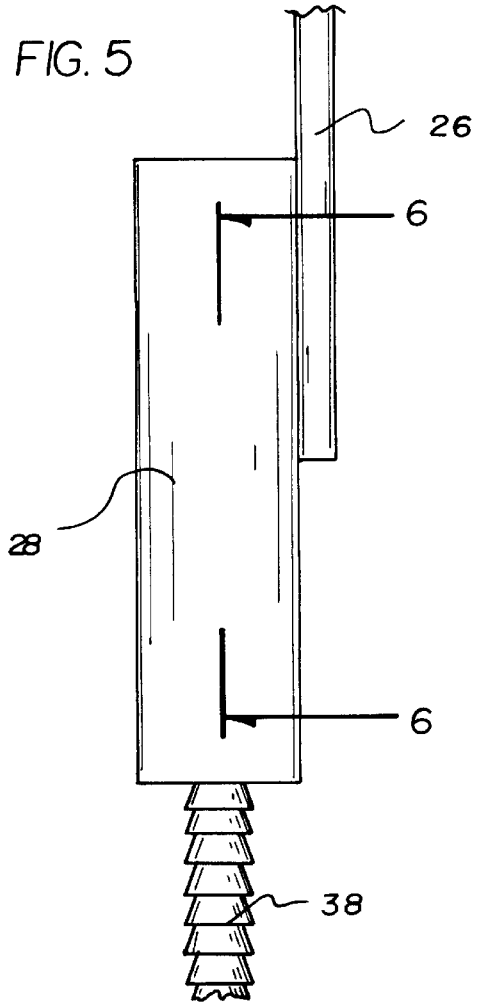
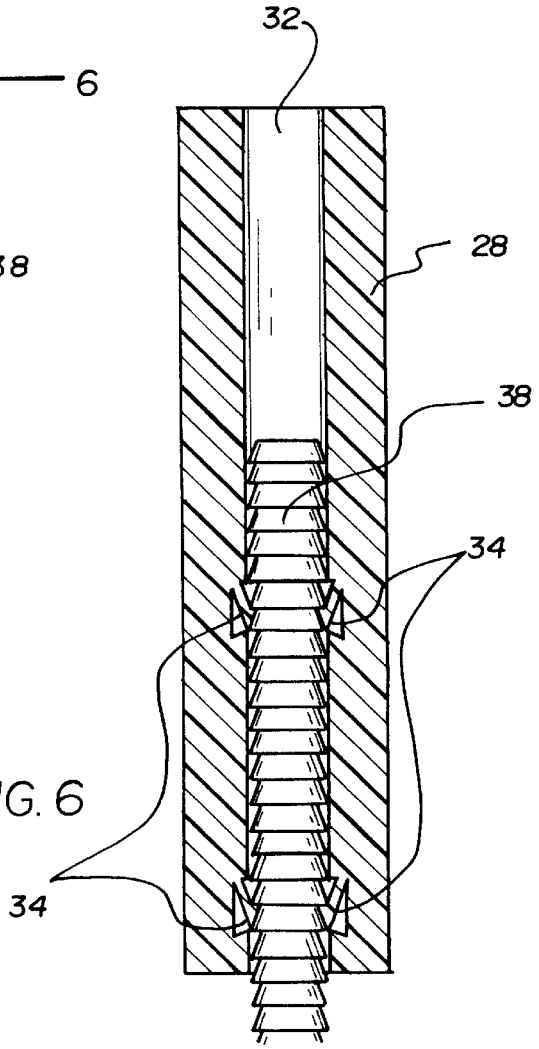
FIG. 6

DROP CEILING HANGING SYSTEM

BACKGROUND OF THE INVENTION

1. Field of the Invention

The present invention relates to drop ceiling hanging system and more particularly pertains to adjustably hanging a drop ceiling.

2. Description of the Prior Art

The use of ceiling hangers is known in the prior art. More specifically, ceiling hangers heretofore devised and utilized for the purpose of suspending a ceiling are known to consist basically of familiar, expected, and obvious structural configurations, notwithstanding the myriad of designs encompassed by the crowded prior art which has been developed for the fulfillment of countless objectives and requirements.

For example, U.S. Pat. Nos. 5,397,090 to Carson et al; 4,426,822 to Gailey; Des 341,668 to Herter; and 3,995,823 to hensel all disclose ceiling hanging and or suspending assemblies. Furthermore, U.S. Pat. No. 5,259,821 to Bryant discloses a linear spacing device, and U.S. Pat. No. 5,085,393 to Ryan discloses a hanger assembly and apparatus.

In this respect, the drop ceiling hanging system according to the present invention substantially departs from the conventional concepts and designs of the prior art, and in doing so provides an apparatus primarily developed for the purpose of adjustably hanging a drop ceiling.

Therefore, it can be appreciated that there exists a continuing need for new and improved drop ceiling hanging system which can be used for adjustably hanging a drop ceiling. In this regard, the present invention substantially fulfills this need.

SUMMARY OF THE INVENTION

In view of the foregoing disadvantages inherent in the known types of ceiling hangers now present in the prior art, the present invention provides an improved drop ceiling hanging system. As such, the general purpose of the present invention, which will be described subsequently in greater detail, is to provide a new and improved drop ceiling hanging system and method which has all the advantages of the prior art and none of the disadvantages.

To attain this, the present invention essentially comprises a system for adjustably interconnecting a drop ceiling and ceiling joist, the system includes a number of elements. Namely, a joist screw defined by a threaded tapered forward end and an arcuate rearward end. This joist screw is adapted to be threadably secured within a ceiling joist. Additionally, a linkage is employed within the system, this linkage is defined by an upper arcuate end and a lower end. The upper arcuate end is adapted to be removably interconnected with the arcuate rearward end of the joist screw. The third element is the adjustment cylinder. This cylinder is defined by an upper end, a lower end, an outer cylindrical surface, and an interior cylindrical passage. The upper end of the outer cylindrical surface of the cylinder is secured to the lower end of the linkage. Additionally, a plurality of upwardly oriented locking elements are positioned upon the interior surface of the cylindrical passage. The fourth element is the J-hook which is approximately twice the length of the linkage. This J-hook is defined by an upwardly extending threaded extent, and a lower drop ceiling frame supporting portion. The threaded extent of the J-hook is adjustably supported within the interior cylindrical passage of the cylinder. The locking elements permit the movement of the threaded extent only toward the upper end of the adjustment cylinder. The drop ceiling frame supporting portion is adapted to be inserted into a hole formed within the drop ceiling frame. Additionally, a layer of resilient material covers the drop ceiling frame supporting portion of the J-hook.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved drop ceiling hanging system which have all the advantages of the prior art ceiling hangers and none of the disadvantages.

It is another object of the present invention to provide new and improved drop ceiling hanging system which may be easily and efficiently manufactured and marketed.

It is further object of the present invention to provide new and improved drop ceiling hanging system which are of durable and reliable constructions.

An even further object of the present invention is to provide new and improved drop ceiling hanging system which are susceptible of a low cost of manufacture with regard to both materials and labor, and which accordingly are then susceptible of low prices of sale to the consuming public, thereby making such drop ceiling hanging system economically available to the buying public.

Still yet another object of the present invention is to provide new and improved drop ceiling hanging system which provide in the apparatuses and methods of the prior art some of the advantages thereof, while simultaneously overcoming some of the disadvantages normally associated therewith.

Even still another object of the present invention is to adjustably hanging a drop ceiling.

Lastly, it is an object of the present invention to provide new and improved system whereby a user can adjustably interconnect a drop ceiling frame to an existing ceiling joist. In its broadest context, the present invention includes a ceiling joist screw which is adapted to be positioned within a ceiling joist; a linkage which is adapted to be connected to the joist screw; an adjustment cylinder which is secured to the lower end of the linkage; and a threaded J-hook which is adapted the adjustably positioned within the adjustment cylinder. With the system of the present invention, a user can easily install a drop ceiling frame to the desired height.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the drop ceiling hanging system constructed in accordance with the principles of the present invention.

FIG. 2 is a view taken along line 2—2 of FIG. 1.

FIG. 5 is a view of the adjustment cylinder employed with the present invention.

FIG. 6 is a sectional view taken along line 6—6 of FIG. 5.

The same reference numerals refer to the same parts through the various Figures.

DESCRIPTION OF THE PREFERRED EMBODIMENT

Figure 3:
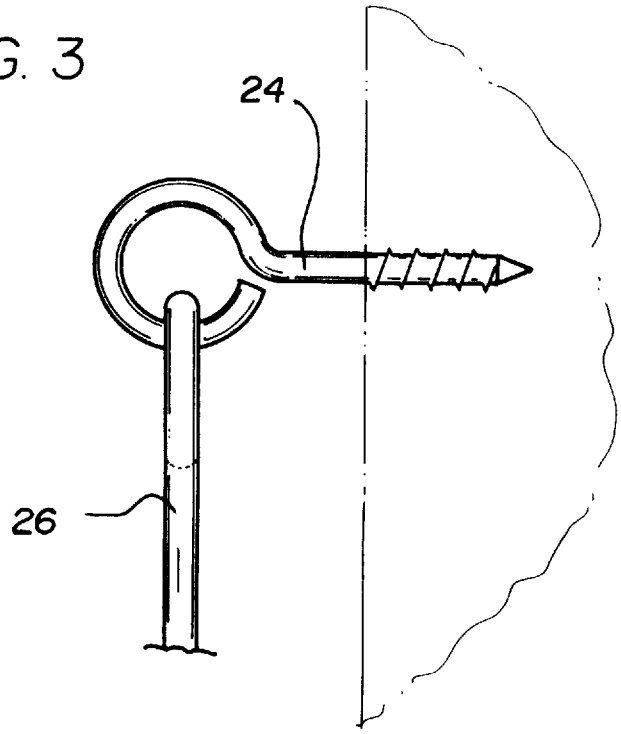
FIG. 3 is a view of the joist screw employed with the present system.

With reference now to the drawings, and in particular to FIG. 1 thereof, the preferred embodiment of the new and improved drop ceiling hanging system embodying the principles and concepts of the present invention and generally designated by the reference numeral 10 will be described.

The present invention relates to a system whereby a user can adjustably interconnect a drop ceiling frame to an existing ceiling joist. In its broadest context, the present invention includes a ceiling joist screw which is adapted to be positioned within a ceiling joist; a linkage which is adapted to be connected to the joist screw; an adjustment cylinder which is secured to the lower end of the linkage; and a threaded J-hook which is adapted the adjustably positioned within the adjustment cylinder. With the system of the present invention, a user can easily install a drop ceiling frame to the desired height. The various elements associated with the present system, and the manner in which they interrelate, will be described in greater detail hereinafter.

The system 10 for adjustably interconnecting a drop ceiling 20 and ceiling joist 22 comprises a number of elements. The first of these elements is a joist screw 24. This joist screw 24 has a threaded tapered forward end and an arcuate rearward end. The joist screw 24 is specifically adapted to be threadably secured within a ceiling joist 22.

The next element is the linkage 26. This linkage 26 is defined by an upper arcuate end and a lower end. The upper arcuate end of this linkage 26 is adapted to be removably interconnected with the arcuate rearward end of the joist screw 24. In this manner, the linkage 26 hangs down from the joist screw 24 which is positioned within the ceiling joist 22.

An adjustment cylinder 28 is secured to the lower end of the linkage 26. This adjustment cylinder 28 is defined by an upper end, a lower end, an outer cylindrical surface, and an interior cylindrical passage 32. It is the upper end of the outer cylindrical surface which is secured to the lower end of the linkage 26. Additionally, a plurality of upwardly oriented locking elements 34 are positioned upon the interior cylindrical passage 32. The function of these locking elements 34 will be described in greater detail hereinafter. As clearly disclosed in FIG. 6, two sets of spaced locking elements are integral with the cylinder and the locking elements of each set are diametrically opposed.

Figure 4:
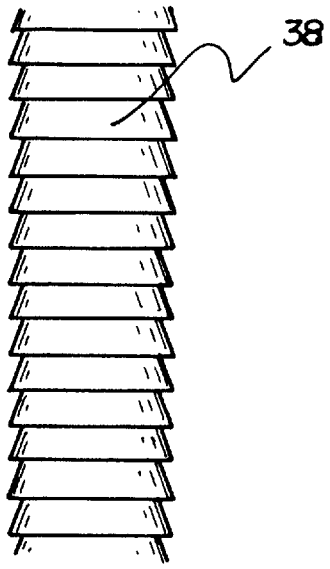
FIG. 4 is a expanded view taken from FIG. 1.

The last element of the system 10 is the J-Hook 36. In the preferred embodiment, this J-hook 36 has a length which is approximately twice the length of the linkage 26. This J-hook 36 can be constructed from an impact resistant plastic or metal. This J-hook 36 is defined by an upwardly extending threaded extent 38, and a lower drop ceiling frame supporting portion 42. The threaded extent 38 of the J-hook 36 is adapted to be adjustably supported within the interior cylindrical passage 32 of the adjustment cylinder 28. The locking elements 34 which are secured to the interior surface permit the movement of the threaded extent 38 only toward the upper end of the adjustment cylinder 28. In other words, due to the upward orientation of the locking elements, and the downward orientation of the threads upon the J-hook 36, the threaded extent 38 of the J-hook 36 can only move in an upward direction relative to the adjustment cylinder 28. As best illustrated in FIG. 4, the threaded extent 38 of the J-hook 36 is made up of a plurality of adjacent fustroconcial segments. The drop ceiling frame supporting portion 42 of the J-hook 36 is adapted to be inserted with a hole formed within a portion of the drop ceiling 20 frame. Additionally, a layer of resilient material 44 covers the drop ceiling frame supporting portion 42 of the J-hook 36. This resilient material 44, which can be a thermoplastic, eliminates any damage the supporting portion 42 may cause the drop ceiling 20.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A system for adjustably interconnecting a drop ceiling and ceiling joist, the system comprising in combination:

a joist screw having a threaded tapered forward end and an arcuate rearward end, the joist screw adapted to be threadably secured within a ceiling joist;

a linkage having a length an upper arcuate end and a lower end, the upper arcuate end adapted to be removably interconnected with the arcuate rearward end of the joist screw thereby hanging down from the joist screw;

an adjustment cylinder having an upper end, a lower end, an outer cylindrical surface, and an interior cylindrical passage, the upper end of the outer cylindrical surface secured to the lower end of the linkage, a plurality of upwardly oriented locking elements positioned upon the interior cylindrical passage, wherein two sets of spaced locking elements are provided which are integral with the cylinder and further wherein the locking elements of each set are diametrically opposed;

a J-hook constructed from metal and being approximately twice the length of the linkage, the J-hook having an upwardly extending threaded extent including a plurality of adjacent frusto-conical segments, and a lower drop ceiling frame supporting portion, the threaded extent of the J-hook being adjustably supported within the interior cylindrical passage with the locking elements permitting movement of the threaded extent only toward the upper end of the adjustment cylinder, the drop ceiling frame supporting portion adapted to be inserted into a hole formed within the drop ceiling frame, a layer of resilient material covering the drop ceiling frame supporting portion of the J-hook, the resilient material functioning to prevent any damage to the drop ceiling.

* * * * *